United States Patent [19]

Linduist et al.

[11] Patent Number: 4,809,398

[45] Date of Patent: Mar. 7, 1989

[54] VACUUM CLEANER COMBINATION LATCH AND ELECTRICAL CONTACT ARRANGEMENT

[75] Inventors: Tommy N. Linduist, Farsta; Milos Vukotic, Skäholmen; Ann-Christine Hedin, Danderyd; Kurt O. Francke, Huddinge, all of Sweden

[73] Assignee: Aktiebolaget Electrolux, Sweden

[21] Appl. No.: 143,648

[22] Filed: Jan. 13, 1988

[30] Foreign Application Priority Data

Feb. 2, 1987 [SE] Sweden ..... 8700389

[51] Int. Cl.[4] ..... A47L 9/00

[52] U.S. Cl. ..... 15/339; 15/327 F

[58] Field of Search ..... 15/327 F, 339

[56] References Cited

U.S. PATENT DOCUMENTS 3,172,743 3/1965 Kowalewski ..... 15/339 X 4,001,912 1/1977 Eriksson ..... 15/339

*Primary Examiner*—Chris K. Moore

*Attorney, Agent, or Firm*—Alfred E. Miller

[57] ABSTRACT

A locking device for a pivotable cover of a vacuum cleaner, which includes at least one locking catch that engages a complementary locking means in order to lock the cover in closed position. The catch is further provided with an electric contact means which during the closing of the cover abuts a corresponding contact means in order to close an electric circuit.

3 Claims, 1 Drawing Sheet

VACUUM CLEANER COMBINATION LATCH AND ELECTRICAL CONTACT ARRANGEMENT

The present invention relates to a latching device, especially for a pivotable cover of a vacuum cleaner, comprising at least one latching catch adapted to releasably engage a complementary latching means in order to latch the cover into a closed position.

The invention is related to a tank type vacuum cleaner of the kind having a front cover which can be opened for the replacement and exchange of the dust filter bag, and to which a suction hose is connected. In such vacuum cleaners it is sometimes necessary to transfer electric current from the vacuum cleaner housing via conduits in the suction hose, either for remote control of the fan motor or for supplying current to a power driven cleaning tool.

The principal object of the invention is to provide a latching device which in addition to the latching of the cover into its closed position also permits transfer of electric current between the cleaner housing and the cover. This has been obtained by means of a latching device of the kind mentioned in the introduction, which according to the invention is characterized in that the catch is provided with an electric contact means adapted to abut a corresponding contact means when the cover is closed in order to close an electric circuit which an open condition when the cover is opened.

Figure 1:
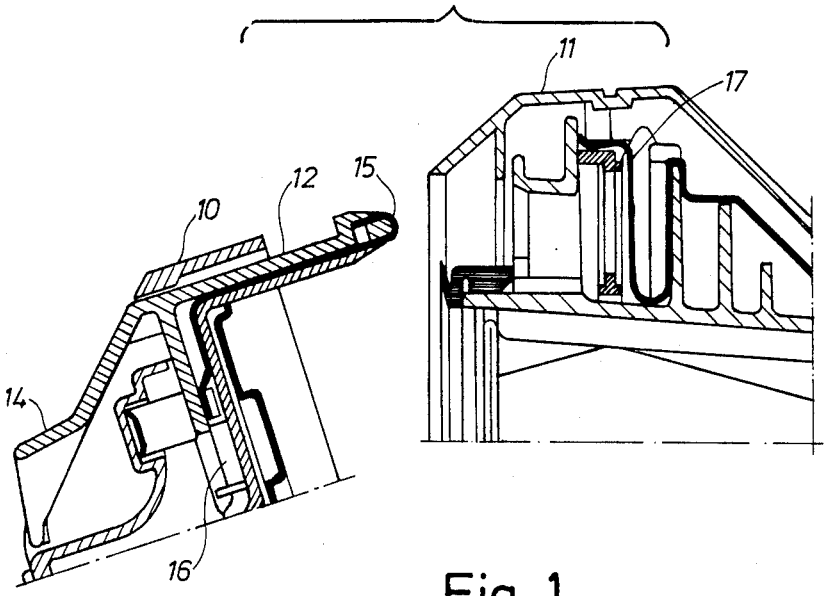
Figure 2:
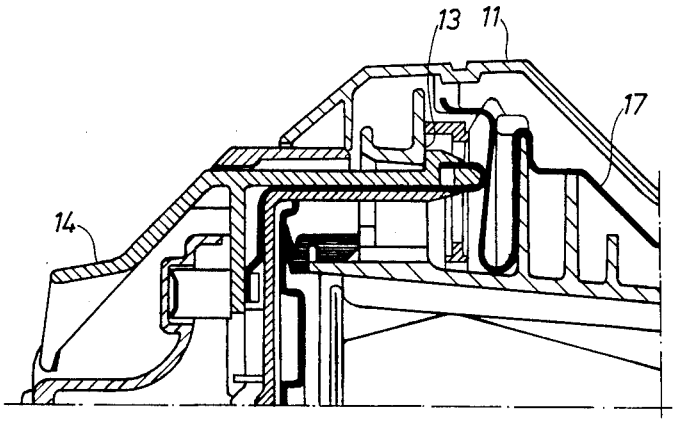

The invention will be described in more detail below with reference to the accompanying drawing in which FIG. 1 is a vertical sectional view of the locking device of the present invention showing the vacuum cleaner housing detached from the cover in which the latter has a latching catch, and FIG. 2 is a vertical sectional view of the locking device with latching catch engaged with the latching means of the housing.

In the drawings, a partially shown cover 10 is hingedly connected (not shown) to a vacuum cleaner housing 11 which is also shown partially. The cover is provided with a latching catch 12 cooperating with a cooresponding latching means in the form of a step 13 in the housing 11. The locking catch is actuatable by means of a lever 14 to release the catch from its engagement when the cover 10 is to be opened.

The locking catch 12 has a contact means 15 which is connected to an electric conduit 16. The major portion of the contact means 15 is disposed insulated within the locking catch and is uncovered at its tip only, in order to abut a complementary contact means 17 in the housing 11, in the closed position of the cover 10. The contact means 17 is resilient and yields to the thrust of the contact means 15, as shown in FIG. 2, whereby good electric contact is ensured. The problem of oxidation of the contact surfaces has also been eliminated by the mechanical rubbing at each opening and closing of the cover 10.

In accordance with the particular requirements a preferred number of locking catches with adherent contact means can be arranged in parallel side by side, relationship corresponding to the number of electric connections that is required in the vacuum cleaner.

We claim:

1. A vacuum cleaner combination latch and electrical contact arrangement comprising a housing, a pivotable cover for said housing, a latching catch on said cover, a complimentary latching means on said housing whereby said catch is adapted to releasably engage said latching means in order to latch the cover in a closed position, said latching catch additionally being provided with an electric contact means and a corresponding contact means in said housing whereby said contact means on said cover is adapted to abut said corresponding contact means on said housing when said cover is closed in order to make an electric circuit.

2. A vacuum cleaner combination latch and electrical contact arrangement as claimed in claim 1 wherein said corresponding contact means in said housing is resilient whereby said contact means and said latching catch cooperate with said resilient contact means in said housing.

3. A vacuum cleaner combination latch and electrical contact arrangement as claimed in claim 1 wherein said latching catch and latching means are provided with adhering electric contact means in parallel and adjacent to each other.

* * * * *

UNITED STATES PATENT AND TRADEMARK OFFICE

CERTIFICATE OF CORRECTION

PATENT NO. : 4,809,398

DATED : March 7, 1989

INVENTOR(S) : Lindquist et al.

It is certified that error appears in the above-identified patent and that said Letters Patent is hereby corrected as shown below:

On the title page:

Linduist et al. should be --Lindquist et al.--.

Under Inventors, delete "Linduist et al." and insert --Lindquist et al.-- and delete "Skaholmen" and insert --Skarholmen--.

Column 1, line 26, before "catch" insert --latching--.

Column 1, line 44, delete "locking" and insert --latching--.

Column 2, line 3, delete "locking" and insert --latching--.

Column 2, line 6, delete "locking" and insert --latching--.

Column 2, line 16, delete "locking" and insert --latching--.

Signed and Sealed this

Seventeenth Day of July, 1990

*Attest:*

*Attesting Officer*

HARRY F. MANBECK, JR.

*Commissioner of Patents and Trademarks*